United States Patent [19]

Ng

[11] Patent Number: 4,758,314

[45] Date of Patent: Jul. 19, 1988

[54] AMORPHOUS FE-CR-P ELECTROPLATING BATH

[75] Inventor: Patrick K. Ng, Rochester Hills, Mich.

[73] Assignee: General Motors Corporation, Detroit, Mich.

[21] Appl. No.: 67,557

[22] Filed: Jun. 29, 1987

[51] Int. Cl.[4] ..... C25D 3/56

[52] U.S. Cl. ..... 204/44.7

[58] Field of Search ..... 204/44.7, 43.1

[56] References Cited

PUBLICATIONS

P. K. Ng et al., The Electrochem. Soc. Extended Abstracts, vol. 85-2, 328 (1985).

L. Q. Feng et al., 8th Int. Cong. On Metallic Corrosion, v. I, p. 1121 (1981).

L. D. McGraw et al, Electrochemical Soc., 106, 302 (1959).

T. Hayashi et al., Plating Surf. Finish., 36 (1979).

*Primary Examiner*—G. L. Kaplan

*Attorney, Agent, or Firm*—Lawrence B. Plant

[57] ABSTRACT

A bath for the electrodeposition of corrosion-resistant, amorphous, Fe-Cr-P coatings comprising chromium sulfate, ferric ammonium sulfate, sodium hypophosphite, citrate ion, citric acid, boric acid and sodium, potassium, magnesium or ammonium sulfate to increase the conductivity of the bath.

1 Claim, No Drawings

AMORPHOUS FE-CR-P ELECTROPLATING BATH

This invention relates to electroplating amorphous, corrosion resistant, iron-chromium-phosphorous alloy coatings.

BACKGROUND OF THE INVENTION

Electrodeposited, amorphous, iron-chromium-phosphorous (i.e., Fe-Cr-P) alloy coatings containing greater than about eight (8) percent (i.e., by weight) chromium, greater than about ten (10) percent phosphorous and the balance substantially iron are known to offer corrosion protection to a variety of substrates. Moreover, baths for the electrodeposition of such coatings have been reported in the literature including P. K. Ng and R. Paluch, "Electrodeposition of Iron-Chromium-Phosphorus Amorphous Alloys", The Electrochemical Society Extended Abstracts, Vol. 85-2, 328 (1985). That Abstract discloses an electroplating bath comprising: chromium sulfate, ferric ammonium sulfate, sodium hypophosphite and glycine as the primary constituents. In that bath, glycine complexes the iron to permit codeposition thereof along with chromium and sodium hypophosphite provides the phosphorous for the deposit which serves to make the deposit amorphous. Ammonium and magnesium sulfate are added merely to increase the bath's conductivity. Other sulfates such as sodium or potassium sulfate may be substituted for either or both the ammonium or magnesium sulfate for the same purpose. Unfortunately, such baths operate at very low current efficiences (i.e., less than about five percent) and result in poor quality deposits characterized by a stress-cracked, dull, mat-like appearance and a coarse nodular microstructure.

It is an object of the present invention to provide an improved electroplating bath for the electrodeposition of relatively bright, lustrous, low-stress, amorphous, Fe-Cr-P coatings at relatively high current efficiences. This and other objects and advantages of the present invention will become more readily apparent from the detailed description thereof which follows.

THE INVENTION

The invention comprehends an improved bath for the electrodeposition of amorphous, Fe-Cr-P coatings including a mixture of citric acid, boric acid and citrate ion in lieu of the glycine used heretofore and more particularly comprehends a bath comprising:

| | RANGE |
|---|---|
| Chromium(as $Cr_2(SO_4)_3.nH_2O$) | 13.6–78 g/l |
| $Fe(NH_4)(SO_4)_2.12\ H_2O$ | 25–60 g/l |
| $NaH_2PO_2.H_2O$ | 10–20 g/l |
| *Citrate ion | 29–51 g/l |
| Citric Acid | 30–40 g/l |
| $H_3BO_3$ | 40–60 g/l |
| #$SO_4^{=}$ ion | 69–90 g/l |
| Cr/Fe ratio | 5–12 |

*as sodium or potassium citrate
#as sodium, potassium, ammonium or magnesium sulfate In the improved bath, the citrate ion acts as a complexing agent for the $Fe^{3+}$ ion to form iron-citrate complexes so that iron and chromium can be codeposited simultaneously. Citric acid and boric acid function as primary and secondary buffering agents, respectively, to control the pH of the bath particularly at the surface of the cathode. In this regard, it is believed that one of the reasons for the poor quality deposit and current efficiency is the existence of a thick iron hydroxide film formed on the surface of the cathode incident to a localized rise in the pH of the electrolyte at the cathode surface. The citric and boric acids serve to substantially reduce the formation of the $Fe(OH)_3$ and allow the deposition to proceed much more efficiently. A chromium-to-iron ratio of about 5–12 is preferred since the deposit has too low a chromium content (i.e., almost all Fe at Cr/Fe=1) when the Cr/Fe ratio is less than about 5 and is too brittle when the ratio exceeds about 12. The surface morphology of deposits formed from the bath of the present invention are smoother and display a lesser degree of nodularity than deposits obtained from glycine complexed baths.

The bath of the present invention may conveniently be operated at about room temperature and over a current density range of about 50 to about 200 milliampere per square centimeter ($mA/cm^2$) to obtain the improved current efficiencies and deposit quality that characterize the present invention. A current density of about 100 $mA/cm^2$ is preferred to obtain maximum current efficiency. Below about 50 $mA/cm^2$, too little chromium is deposited. Over about 200 $mA/cm^2$, the current efficiency drops off considerably. Generally speaking tests have shown that as the current density increases the chromium content of the deposit increases, the iron content decreases and the phosphorous content remains relatively constant in the range of about 12–15%. For example, using a preferred bath comprising:

| | |
|---|---|
| $Cr_2(SO_4)_3.nH_2O$ [19.5% Cr] | 167 g/l |
| $Fe(NH_4)(SO_4)_2.12\ H_2O$ | 60 g/l |
| $NaH_2PO_2.H_2O$ | 10 g/l |
| $(NH_4)_2SO_4$ | 80 g/l |
| $K_2SO_4$ | 20 g/l |
| $Na_3C_6H_5O_7.H_2O$ | 45 g/l |
| $C_6H_8O_7.H_2O$ | 30 g/l |
| $H_3BO_3$ | 40 g/l |
| pH | 2 |
| Temp. | 25° C. |

one series of tests yielded the results appearing in Table I after the passage of one hundred (100) coulombs of charge.

TABLE I

| Current Density, $mA/cm^2$ | Wt % Fe | Wt % Cr | Wt % P | Current Efficiency, % |
|---|---|---|---|---|
| 50 | 79.7 | 5.1 | 15.2 | 17.1 |
| 100 | 76.6 | 10.6 | 12.8 | 20.3 |
| 150 | 71.7 | 15.5 | 12.8 | 17.4 |
| 200 | 70.6 | 16.7 | 12.6 | 9.97 |
| 250 | 69.6 | 16.8 | 13.6 | 6.45 |
| 300 | 67.5 | 18.6 | 13.9 | 6.46 |

In that series of tests, the cathode was a thin, copper, foil disc having a diameter of 1.27 cm and immersed in a catholyte (i.e., the bath of the present invention) separated from an anolyte (i.e., 10% by vol. $H_2SO_4$ saturated with $K_2SO_4$) by a cation selective membrane (i.e., Nafion sold by the DuPont Co.). The cumulative effects of citrate, boric acid and citric acid on the preferred bath (i.e., at 100 $mA/cm^2$) of the example are illustrated by the example set forth in Table II wherein the several ingredients were added in the sequence (1)–(3) shown.

TABLE II

| | (1) Citrate Only | (2) Citrate & Boric Acid | (3) Citrate + Boric & Citric Acids |
|---|---|---|---|
| Cr | 9.2 | 11.8 | 22.6 |
| Fe | 79.1 | 74.8 | 67.1 |
| P | 11.7 | 13.4 | 10.3 |
| Eff. | 6.9 | 13.1 | 18.1 |

The current efficiencies reported in Table II are calculated by assuming a 3-electron transfer for both the Fe and Cr and a 1-electron transfer for the P. When the boric acid was added, significant improvements in deposit appearance (i.e. brightness and smoothness) and current efficiency was evident. Finally, when citric acid was added, the current efficiency and chromium content climbed significantly with a corresponding decrease in the iron and phosphorous content.

While the invention has been described in terms of a certain specific embodiment thereof it is not intended to be limited thereto but rather only to the extent set forth hereafter in the claims which follows.

The embodiments of the invention in which an exclusive property or privilege is claimed are defined as follows:

1. An aqueous bath for the electrodeposition of corrosion-resistant, amorphous, iron-chromium-phosphorous alloy coatings comprising:

| | | RANGE |
|---|---|---|
| Chromium (as $Cr_2(SO_4)_3.\eta H_2O$) | about | 13.6–78 g/l |
| $Fe(NH_4)(SO_4)_2.12H_2O$ | about | 25–60 g/l |
| $NaH_2PO_2.H_2O$ | about | 10–20 g/l |
| Citrate ion | about | 29–51 g/l |
| Citric Acid | about | 30–40 g/l |
| $H_3BO_3$ | about | 40–60 g/l |
| Cr/Fe ratio | | 5–12 |

and a conductivity improver selected from the group consisting of sodium sulfate, potassium sulfate, ammonium sulfate, magnesium sulfate and combinations thereof to provide a sulfate concentration of about 69–90 g/l.

* * * * *